US011136768B2

(12) United States Patent
Brown et al.

(10) Patent No.: US 11,136,768 B2
(45) Date of Patent: Oct. 5, 2021

(54) INSIDE CORNER DRYWALL FINISHING

(71) Applicants: Steven Joseph Brown, Omemee (CA); Lloyd Murray Lennox, Pickering (CA)

(72) Inventors: Steven Joseph Brown, Omemee (CA); Lloyd Murray Lennox, Pickering (CA)

( * ) Notice: Subject to any disclaimer, the term of this patent is extended or adjusted under 35 U.S.C. 154(b) by 0 days.

(21) Appl. No.: 16/788,445

(22) Filed: Feb. 12, 2020

(65) Prior Publication Data

US 2021/0246671 A1 Aug. 12, 2021

(51) Int. Cl.
*E04F 21/165* (2006.01)

(52) U.S. Cl.
CPC ..... *E04F 21/1657* (2013.01)

(58) Field of Classification Search
CPC ... E04F 13/06; E04F 2013/063; E04F 19/022; E04F 21/1657; E04F 13/068; E04F 13/0733
See application file for complete search history.

(56) References Cited

U.S. PATENT DOCUMENTS 3,275,587 A * 9/1966 Weller ..... C08L 63/00 523/420
3,321,881 A * 5/1967 Alleaume ..... F16L 43/00 52/276
3,350,825 A * 11/1967 Rillo ..... E04F 13/042 52/287.1
3,496,119 A * 2/1970 Fitzgerald ..... C08G 59/68 427/386
3,754,363 A * 8/1973 Schneller ..... E04F 19/022 52/287.1
3,771,342 A * 11/1973 Alleaume ..... B21D 13/02 72/379.2
4,141,187 A * 2/1979 Graves ..... E04D 7/00 219/213
4,281,788 A * 8/1981 Aeba ..... B65D 5/2042 229/115
4,603,517 A * 8/1986 Lyons, Jr. ..... E04D 13/1407 52/219
4,722,153 A * 2/1988 Hardy ..... E04F 13/06 52/254
4,763,455 A * 8/1988 Schneller ..... E04F 13/06 52/255
4,835,925 A * 6/1989 Hoffmann, Sr. ..... E04F 13/06 52/287.1
4,876,837 A * 10/1989 Kelly ..... B21B 1/082 52/287.1
5,045,374 A 9/1991 Tucker
5,086,598 A * 2/1992 Weldy ..... E04F 13/06 52/241

(Continued)

*Primary Examiner* — James M Ference
(74) *Attorney, Agent, or Firm* — Stratford Group Ltd.

(57) ABSTRACT

An inside corner drywall finishing comprising a first segment composed of a first side and a second side, a second segment composed of a first side and a second side, a third segment composed of a first side and a second side, a flap composed of a first side and a second side, the first side of the first segment attached to the first side of the flap wherein the first segment is affixed to the flap, the second side of the first segment attached to the first side of the second segment wherein the first segment is affixed to the second segment and the second side of the second segment attached to the first side of the third segment wherein the second segment is affixed to the third segment.

14 Claims, 5 Drawing Sheets

(56) References Cited

U.S. PATENT DOCUMENTS 5,131,198 A * 7/1992 Ritchie ..... E04F 13/06 52/287.1
RE34,547 E 2/1994 Weldy
5,283,997 A * 2/1994 Lackie ..... A47B 95/00 52/254
5,505,032 A 4/1996 Wasserman et al.
5,544,463 A 8/1996 Bergin
5,644,892 A * 7/1997 Smythe, Jr. ..... E04F 13/06 52/254
5,647,182 A 7/1997 Rutherford
5,893,246 A 4/1999 Smythe, Jr.
D431,304 S 9/2000 Koenig, Jr. et al.
6,145,259 A * 11/2000 Koenig, Jr. ..... E04F 13/06 52/255
6,148,573 A * 11/2000 Smythe, Jr. ..... B32B 29/00 52/255
6,332,296 B1 12/2001 Moscovitch
6,431,365 B1 * 8/2002 Money ..... B65D 5/4204 206/776
6,438,914 B1 * 8/2002 Robertson ..... E04F 13/06 52/255
6,467,209 B1 * 10/2002 Vickers ..... F21V 1/22 40/617
6,754,993 B1 * 6/2004 Mayle ..... E04D 3/38 52/287.1
7,950,569 B2 * 5/2011 Goldman ..... B65D 5/3607 229/115
8,046,963 B2 11/2011 Wambaugh et al.
9,482,010 B2 11/2016 Kartler
2001/0039775 A1 * 11/2001 Smythe, Jr. ..... E04F 13/06 52/287.1
2004/0060252 A1 4/2004 Daly, IV
2005/0055890 A1 * 3/2005 Summy ..... E06B 1/62 52/58
2005/0081476 A1 * 4/2005 Budzik ..... E04F 13/06 52/716.1
2005/0210784 A1 * 9/2005 Hahn ..... E04F 19/0436 52/287.1
2006/0053699 A1 * 3/2006 Lolley ..... E04B 1/66 52/58
2006/0070324 A1 * 4/2006 Daly, IV ..... E04F 13/042 52/287.1
2006/0123713 A1 * 6/2006 Faurholdt ..... E04D 13/1475 52/58
2008/0083179 A1 * 4/2008 Riggs ..... E04F 19/02 52/287.1
2009/0090068 A1 * 4/2009 O'rourke ..... E06B 1/62 52/58
2009/0277102 A1 * 11/2009 Bishop ..... E04D 3/38 52/58
2010/0215900 A1 * 8/2010 Conboy ..... C09J 7/35 428/137
2010/0218445 A1 * 9/2010 Smythe ..... E04F 13/06 52/255
2012/0151870 A1 * 6/2012 Summy ..... E04F 21/0038 52/741.4
2012/0216474 A1 * 8/2012 Railkar ..... E04D 13/1407 52/302.6
2013/0047533 A1 2/2013 Diener
2014/0165478 A1 * 6/2014 Railkar ..... E04D 13/00 52/58
2017/0314275 A1 * 11/2017 Rosenthal ..... B29C 48/21
2018/0251984 A1 * 9/2018 Bodner ..... E04F 19/06

* cited by examiner

INSIDE CORNER DRYWALL FINISHING

FIELD OF THE INVENTION

The present disclosure relates to an inside corner drywall finishing, more specifically but not by way of limitation, an inside corner drywall finishing that is effortlessly installed to the common vertex of three adjacent walls for effective joining and sealing of drywall joints, as well as any gaps, cracks or any other openings and deficiencies.

BACKGROUND

Between applying a semi-liquid sealing substrate, drying times between coats, and smoothing out and sanding imperfections, drywall finishing is an exceedingly lengthy process. Presently, the majority of the skilled work for a drywall finisher is required in finishing inside corners for three-way wall connections. This is partially due to connections are almost never completely orthogonal which requires modification by the drywall finisher to achieve straight lines. Factoring in the number of inside corners that are typically present in residential and commercial construction projects, a great deal of skilled labour, time and money is exhausted. Current methods for finishing inside corners largely include caps or using three rectangular pieces of tape finishing. These methods may require some modifications, which add to lengthy installations, as well as pre-fill and dry times.

U.S. Pat. No. 5,893,246 A (Smythe Jr.) discloses an inside drywall corner finishing. Shortcomings include the requirement to apply drywall mud during assembly, as well as any adjustments required for walls that are not orthogonal are impractical and time consuming to implement.

All documents cited herein are incorporated by reference.

There is a need for inside corner drywall finishing that effectively joins and seals joints, gaps, cracks, holes any other openings and deficiencies, that is durable, is reinforced to prevent crackling, slipping or bubbling, and can be effortlessly employed and adjusted in a timely manner.

BRIEF SUMMARY

It is the object of the present invention to provide an inside corner drywall finishing.

In accordance with an aspect of the invention, there is provided an inside corner drywall finishing comprising a first segment composed of a first side and a second side, a second segment composed of a first side and a second side, a third segment composed of a first side and a second side, a flap composed of a first side and a second side, the first side of the first segment attached to the first side of the flap wherein the first segment is affixed to the flap, the second side of the first segment attached to the first side of the second segment wherein the first segment is affixed to the second segment and the second side of the second segment attached to the first side of the third segment wherein the second segment is affixed to the third segment.

In accordance with another aspect of the invention, there is provided a method of using the inside corner drywall finishing to join and seal a common vertex and joints between three adjacent walls, comprising applying the first segment against a first wall between a first wall and third wall joint and a first wall and second wall joint, applying the second segment against a second wall between the first wall and second wall joint and a second wall and third wall joint, applying the flap against a third wall between the second wall and third wall joint and the first wall and third wall joint and applying the third segment against the flap and the third wall between the second wall and third wall joint and the first wall and third wall joint.

In accordance with an embodiment of the invention, wherein one or more of the first segment, the second segment or the third segment are triangular and the triangular segments are equilateral.

In accordance with an embodiment of the invention, wherein one or more of the first segment, the second segment or the third segment are semicircular.

In accordance with an embodiment of the invention, wherein one or more of the first segment, the second segment, the third segment or the flap are affixed to their respective neighboring parts at a ninety-degree angle.

In accordance with an embodiment of the invention, wherein the first segment, the second segment, the third segment and the flap are of a unitary construction.

In accordance with an embodiment of the invention, wherein one or more of the first segment, the second segment, the third segment or the flap are separated and attachable to the inside corner drywall finishing.

In accordance with an embodiment of the invention, wherein an adhesive is present on one or more of the first segment, the second segment, the third segment or the flap.

In accordance with an embodiment of the invention, wherein the adhesive is water activated.

In accordance with an embodiment of the invention, wherein the adhesive is activated by a peel-away material covering the adhesive.

In accordance with an embodiment of the invention, wherein one or more of the first segment, the second segment, the third segment or the flap tapers away from a common vertex of the first segment, the second segment, the third segment and the flap.

In accordance with an embodiment of the invention, wherein the inside corner drywall finishing is composed of one or a combination of paper, metal or plastic.

In accordance with an embodiment of the invention, wherein the second wall is a ceiling.

In accordance with an embodiment of the invention, wherein an adhesive on one or more of the first segment, the second segment or the third segment is activated prior to application.

In accordance with an embodiment of the invention, wherein the adhesive on the flap is activated prior to applying the flap against the third wall.

In accordance with an embodiment of the invention, wherein the adhesive on the flap is activated prior to applying the third segment against the flap.

In accordance with an embodiment of the invention, wherein a semi-liquid sealing substrate is applied to one or more of the first segment, the second segment or the third segment following application.

In accordance with an embodiment of the invention, wherein a semi-liquid sealing substrate is applied to the flap following application of the flap against the third wall.

In accordance with an embodiment of the invention, wherein a semi-liquid sealing substrate is applied to the flap following application of the third segment against the flap.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

The details of one or more embodiments of the subject matter of this specification are set forth in the accompanying drawings and the description below. Other features, aspects, and advantages of the subject matter will become apparent from the description, the drawings, and the claims.

Like reference numbers and designations in the various drawings indicate like elements.

Figure 1:
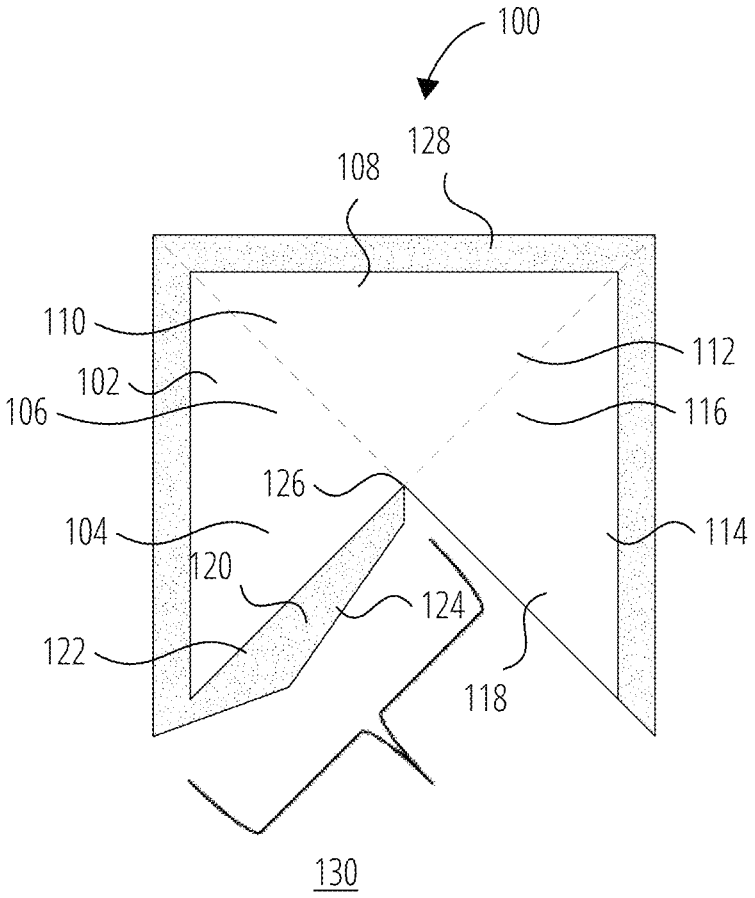
FIG. 1 illustrates an unassembled view 100 in accordance with one embodiment.

FIG. 1 depicts an unassembled view 100 of an inside corner drywall finishing as in one embodiment. In this embodiment, the inside corner drywall finishing is shown comprising a first segment 102 composed of a first side of the first segment 104 and a second side of the first segment 106, a second segment 108 composed of a first side of the second segment 110 and a second side of the second segment 112, a third segment 114 composed of a first side of the third segment 116 and a second side of the third segment 118 and a flap 120 composed of a first side of the flap 122 and a second side of the flap 124. Furthermore, the first side of the first segment 104 is attached to first side of the flap 122 wherein the first segment 102 is affixed to the flap 120, the second side of the first segment 106 is attached to first side of the second segment 110 wherein the first segment 102 is affixed to the second segment 108 and the second side of the second segment 112 is attached to the first side of the third segment 116 wherein the second segment 108 is affixed to the third segment 114. A common vertex 126 is present at the center of the inside corner drywall finishing. Additionally, this embodiment displays an adhesive 128 around the perimeter of the first segment 102, second segment 108 and third segment 114 which may be employed to secure the inside corner drywall finishing against a surface. Furthermore, this embodiment also displays the adhesive 128 on the flap 120, which may be employed to further secure the flap 120 to the third segment 114 once the third segment 114 is applied against the flap 120 during assembly. The flap contains a tapered feature 130 which is employed to reinforce the straight lines of the inside corner drywall finishing, as well as assist in developing a smooth transition of a semi-liquid sealing substrate along a wall joint. The inside corner drywall finishing may be employed to join and seal gaps, cracks, holes and other opening or deficiencies commonly present drywall.

In additional embodiments, one or more of the first segment 102, the second segment 108 or the third segment 114 are triangular. In another embodiment, the triangles triangular segments are equilateral. In another embodiment, one or more of the first segment 102, the second segment 108 or the third segment 114 are semicircular. In another embodiment, one or more of the first segment 102, the second segment 108, the third segment 114 or the flap 120 are affixed to their respective neighboring parts at a ninety-degree angle. In another embodiment, the first segment 102, the second segment 108, the third segment 114 and the flap 120 are of a unitary construction. In another embodiment, an adhesive 128 is present on one or more of the first segment 102, the second segment 108, the third segment 114 or the flap 120. In another embodiment, the adhesive 128 is water activated. In another embodiment, the adhesive 128 is activated by a peel-away material covering the adhesive 128. In another embodiment, one or more of the first segment 102, the second segment 108, the third segment 114 or the flap 120 tapers away from a common vertex 126 of the first segment 102, the second segment 108, the third segment 114 and the flap 120.

Figure 2:
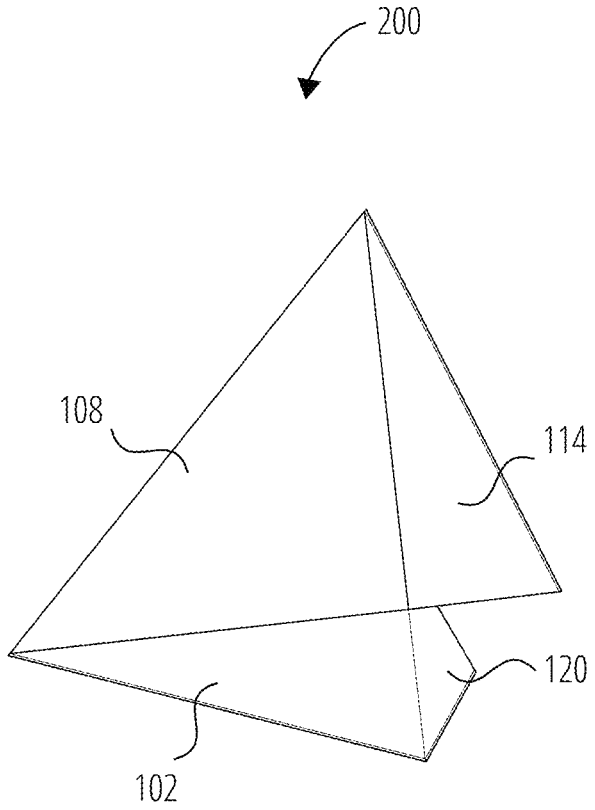
FIG. 2 illustrates a partially assembled view 200 in accordance with one embodiment.

FIG. 2 depicts a partially assembled view 200 of an inside corner drywall finishing as in one embodiment. In this embodiment, the inside corner drywall finishing is shown partially assembled such that the first segment 102 is adjacent to the second segment 108 while the third segment 114 and flap 120 remain unaltered from FIG. 1. In additional embodiments, the inside corner drywall finishing is composed of one or a combination of paper, metal or plastic. In additional embodiments, one or more of the first segment 102, the second segment 108, the third segment 114 and the flap 120 are separated and attachable to said inside corner drywall finishing.

Figure 3:
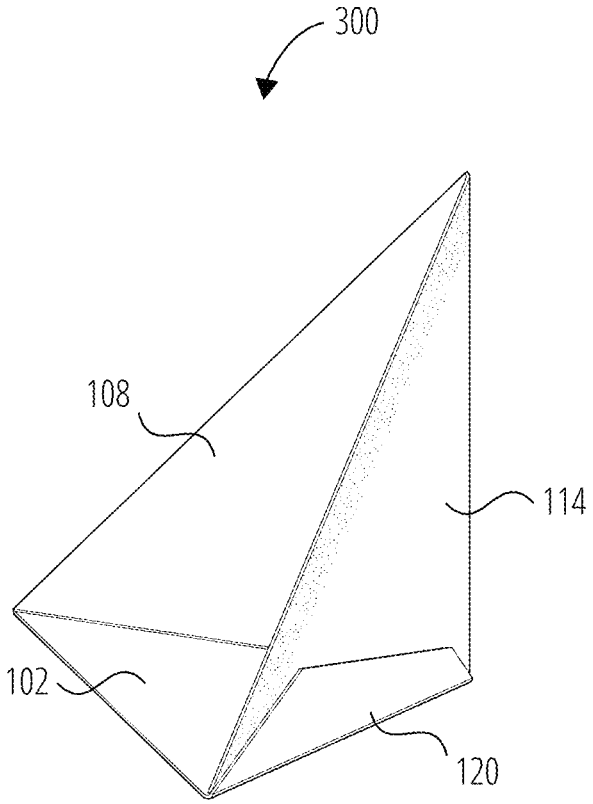
FIG. 3 illustrates an assembled view 300 in accordance with one embodiment.

FIG. 3 depicts an assembled view 300 of an inside corner drywall finishing as in one embodiment. In this embodiment, the inside corner drywall finishing is shown fully assembled such that the first segment 102, the second segment 108 and the third segment 114 are all adjacent to one another, as well, the flap 120 is shown against the third segment 114 enclosing the inside corner drywall finishing. The flap 120 and the third segment 114 are not directly affixed to one another, which allows for modification of the inside corner drywall finishing against three adjacent walls. This is an important feature as drywall is generally not aligned at perfect 90-degree angles and the flexibility to adapt to a wide range of angles greatly reduces the time, effort and skill required of the drywall finisher.

Figure 4:
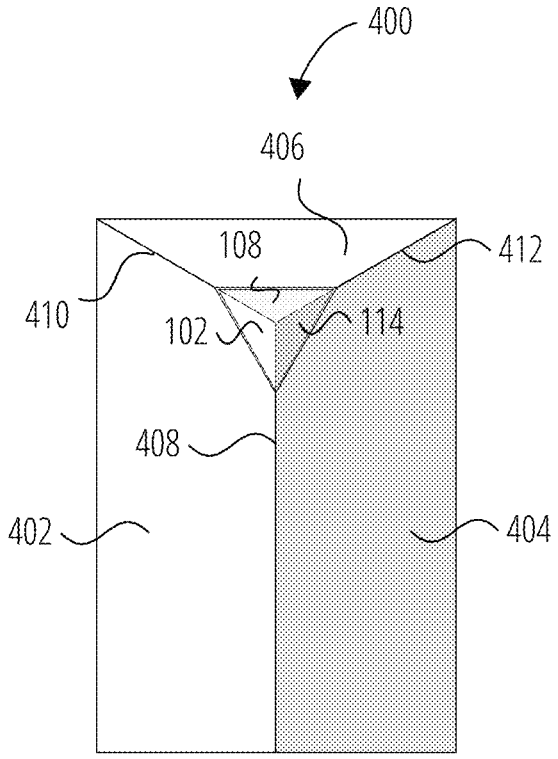
FIG. 4 illustrates a ceiling application 400 in accordance with one embodiment.

FIG. 4 depicts a ceiling application 400 of an inside corner drywall finishing as in one embodiment. In this embodiment, the inside corner drywall finishing is shown fully assembled and applied against a first wall 402, a ceiling 406 and a third wall 404, where the ceiling 406, the first wall 402 and the third wall 404 are adjacent to each other. During assembly and application, the first segment 102 is applied against the first wall 402 between a first wall and third wall joint 408 and a first wall and ceiling joint 410. Subsequently, the second segment 108 is applied against the ceiling 406 between the first wall and ceiling joint 410 and a ceiling and third wall joint 412. Next, the flap 120 is applied against the third wall 404 between said ceiling and third wall joint 412 and said first wall and third wall joint 408. Finally, the third segment 114 is applied against the flap 120 and the third wall 404 between the ceiling 406 and third wall joint 412 and the first wall and third wall joint 408. In another embodiment, the inside corner drywall finishing may be assembled and applied to an interior eave where two ceilings meet a wall, where the inside corner drywall finishing may be customizable to various angled roof lines.

Figure 5:
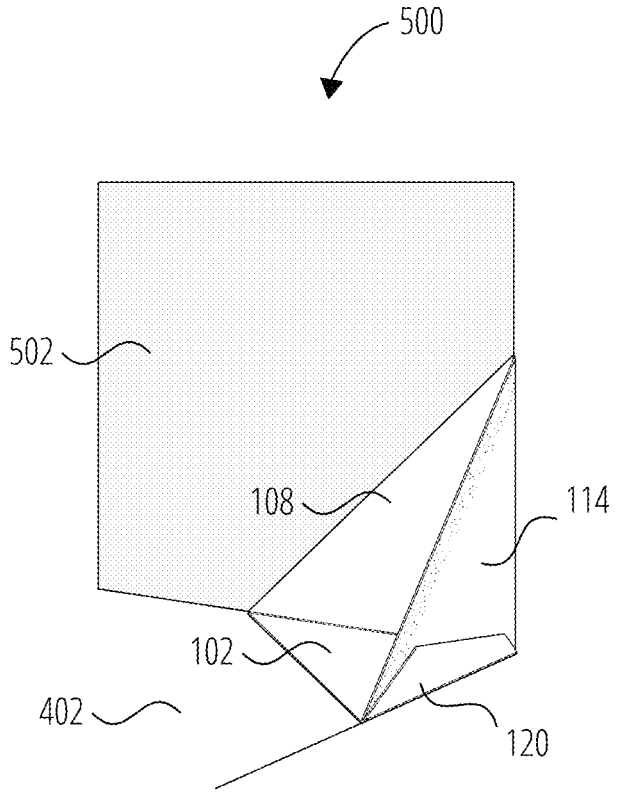
FIG. 5 illustrates a base application 500 in accordance with one embodiment.

FIG. 5 depicts a base application 500 of an inside corner drywall finishing as in one embodiment. In this embodiment, the inside corner drywall finishing is shown fully assembled and applied against a first wall 402, a second wall 502 and a third wall 404 not fully shown but implied, where the first wall 402 is the base of three adjacent walls. An example of this embodiment would be shelving built into drywall.

In additional embodiments, the adhesive on one or more of the first segment 102, the second segment 108 or the third segment 114 is activated prior to application. In another embodiment, the adhesive on the flap 120 is activated prior to applying the flap 120 against the third wall 404. In another embodiment, the adhesive on the flap 120 is activated prior to applying the third segment 114 against the flap 120. In another embodiment, a semi-liquid sealing substrate is applied to one or more of the first segment 102, the second segment 108 or the third segment 114 following application. In another embodiment, the semi-liquid sealing substrate is applied to the flap 120 following application of the flap 120 against the third wall 404. In another embodiment, the semi-liquid sealing substrate is applied to the flap 120 following application of the third segment 114 against the flap 120. Embodiments of semi-liquid sealing substrate include, but are not limited to, joint compound, spackling paste and plaster.

The foregoing descriptions of specific embodiments of the present invention have been presented for purposes of illustration and description. They are not intended to be exhaustive or to limit the invention and method of use to the precise forms disclosed. Obviously, many modifications and variations are possible in light of the above teaching. The embodiments described were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient but is intended to cover the application or implementation without departing from the spirit or scope of the claims of the present invention.

What is claimed is:

1. An inside corner drywall finishing comprising:

a first segment composed of a first side and a second side, said first side and said second side constructed from paper;

a second segment composed of a first side and a second side, said first side and said second side constructed from paper;

a third segment composed of a first side and a second side, said first side and said second side constructed from paper;

a flap composed of a first side and a second side, said first side and said second side constructed from paper;

wherein said first side of said first segment is attached to said first side of said flap;

said second side of said first segment is attached to said first side of said second segment; and said second side of said second segment is attached to said first side of said third segment.

2. The inside corner drywall finishing of claim 1, wherein one or more of said first segment, said second segment and said third segment are triangular.

3. The inside corner drywall finishing of claim 2, wherein said one or more of said triangular segments of said first segment, said second segment and said third segment are equilateral.

4. The inside corner drywall finishing of claim 1, wherein one or more of said first segment, said second segment and said third segment are semicircular.

5. The inside corner drywall finishing of claim 1, wherein said first segment, said second segment, said third segment and said flap are of a unitary construction.

6. The inside corner drywall finishing of claim 1, wherein one or more of said first segment, said second segment, said third segment and said flap are separated and attachable to said inside corner drywall finishing.

7. The inside corner drywall finishing of claim 1, wherein an adhesive is present on one or more of said first segment, said second segment, said third segment and said flap.

8. The inside corner drywall finishing of claim 7, wherein said adhesive is activated by a peel-away material covering the adhesive.

9. The inside corner drywall finishing of claim 1, wherein one or more of said first segment, said second segment, said third segment and said flap tapers away from a common vertex of said first segment, said second segment, said third segment and said flap.

10. A method of using the inside corner drywall finishing of claim 1, to join and seal a common vertex and joints between three adjacent walls, comprising:

applying said first segment against a first wall between a first wall and third wall joint and a first wall and second wall joint, wherein a joint compound is applied to said first segment following application of said first segment against said first wall;

applying said second segment against a second wall between said first wall and second wall joint and a second wall and third wall joint, wherein a joint compound is applied to said second segment following application of said second segment against said second wall;

applying said flap against a third wall between said second wall and third wall joint and said first wall and third wall joint, wherein a joint compound is applied to said flap following application of said flap against said third wall; and applying said third segment against said flap and said third wall between said second wall and third wall joint and said first wall and third wall joint, wherein a joint compound is applied to said third segment following application of said third segment against said flap.

11. The method of using the inside corner drywall finishing of claim 10, wherein said second wall is a ceiling.

12. The method of using the inside corner drywall finishing of claim 10, wherein an adhesive on one or more of said first segment, said second segment, said third segment and said flap is activated prior to application to one or more of said first wall, said second wall and a third wall.

13. The method of using the inside corner drywall finishing of claim 12, wherein said adhesive on said flap is activated prior to applying said flap against said third wall.

14. The method of using the inside corner drywall finishing of claim 10, wherein said adhesive on said flap is activated prior to applying said third segment against said flap.

* * * * *